US011643822B2

(12) United States Patent
Li

(10) Patent No.: US 11,643,822 B2
(45) Date of Patent: May 9, 2023

(54) DECORATIVE SURFACE COVERING ELEMENT, SURFACE COVERING ELEMENT COVERING, AND METHOD OF PRODUCING SUCH A DECORATIVE SURFACE COVERING ELEMENT

(71) Applicant: Northann Building Solutions LLC, Elk Grove, CA (US)

(72) Inventor: Lin Li, Elk Grove, CA (US)

(73) Assignee: Northann Building Solutions LLC, Elk Grove, CA (US)

( * ) Notice: Subject to any disclaimer, the term of this patent is extended or adjusted under 35 U.S.C. 154(b) by 0 days.

(21) Appl. No.: 17/888,232

(22) Filed: Aug. 15, 2022

(65) Prior Publication Data

US 2022/0396952 A1 Dec. 15, 2022

Related U.S. Application Data

(63) Continuation of application No. 16/862,980, filed on Apr. 30, 2020, now Pat. No. 11,421,424.

(30) Foreign Application Priority Data

Mar. 12, 2020 (NL) ..... 2025115

(51) Int. Cl.
*E04F 13/08* (2006.01)
*E04F 15/02* (2006.01)

(52) U.S. Cl.
CPC ..... *E04F 13/0873* (2013.01); *E04F 13/0866* (2013.01); *E04F 13/0894* (2013.01); *E04F 15/02038* (2013.01); *E04F 2201/0138* (2013.01); *E04F 2201/0153* (2013.01); *E04F 2201/043* (2013.01)

(58) Field of Classification Search
CPC ..... E04F 13/0873; E04F 13/0894; E04F 15/02038; E04F 2201/6138
See application file for complete search history.

(56) References Cited

U.S. PATENT DOCUMENTS

| | | | | |
|---|---|---|---|---|
| 11,541,630 | B2 * | 1/2023 | Pervan | B32B 27/42 |
| 2006/0156672 | A1 * | 7/2006 | Laurent | B44C 3/005 52/589.1 |
| 2007/0175148 | A1 * | 8/2007 | Bergelin | E04F 15/02033 52/480 |
| 2012/0317911 | A1 * | 12/2012 | Huang | E04F 15/02 52/468 |
| 2019/0383030 | A1 * | 12/2019 | Lombaert | B32B 27/32 |
| 2022/0161539 | A1 * | 5/2022 | Clement | B32B 5/022 |
| 2022/0341187 | A1 * | 10/2022 | De Rick | E04F 15/02038 |
| 2022/0412101 | A1 * | 12/2022 | De Rick | E04F 15/02038 |

* cited by examiner

*Primary Examiner* — Gisele D Ford
(74) *Attorney, Agent, or Firm* — The Webb Law Firm

(57) ABSTRACT

The invention relates to a decorative surface covering element, in particular a floor panel, ceiling panel or wall panel. The invention also relates to a panel covering, such as a floor covering, ceiling covering or wall covering, comprising a plurality of panels according to the invention. The invention further relates to a method of producing a decorative surface covering element according to the invention.

18 Claims, 8 Drawing Sheets

DECORATIVE SURFACE COVERING ELEMENT, SURFACE COVERING ELEMENT COVERING, AND METHOD OF PRODUCING SUCH A DECORATIVE SURFACE COVERING ELEMENT

CROSS-REFERENCE TO RELATED APPLICATION

This application is a continuation of U.S. patent application Ser. No. 16/862,980, filed on Apr. 30, 2020 which claims priority to The Netherlands Patent Application No. 2025115 filed Mar. 12, 2020, the disclosures of which are hereby incorporated by reference in their entirety.

BACKGROUND OF THE INVENTION

Field of the Invention

The invention relates to a decorative surface covering element, in particular a floor surface covering element, ceiling surface covering element or wall surface covering element. The invention also relates to a surface covering element covering, such as a floor covering, ceiling covering or wall covering, comprising a plurality of surface covering elements according to the invention. The invention further relates to a method of producing a decorative surface covering element according to the invention.

Description of Related Art

During the construction of a home, building or other structure, there will almost always be an unfinished floor surface such as a slab of concrete, a wood sub-structure or the like, which needs to be finished to offer a more appealing and/or polished appearance. This is also the case for most unfinished wall surfaces. In many cases, tiles will be used to finish either a floor surface or a wall surface, with the tiles often being made of real marble or stone, or depending on budgetary constraints, of porcelain or ceramic. Traditionally, such tiles are secured to the unfinished floor slab or wall surface using a cement-like mixture, with one or more tiles disposed closely next to each other, and leaving a small separation between the sides of adjacent tiles. Forming this separation between tiles is often tedious and requires the use of spacers to ensure uniformity and alignment of the tiles. Also, this separation will later be filled with a grout mixture as part of the installation process, which creates a "grout line" around the sides of the tiles. In general, the process of installing tile and creating the grout line involves a significant amount of time, which adds to the labor and overall cost of the project.

Over the last several years, flooring products and tiles have been made from synthetic materials and configured to imitate the look of a real tile of marble, stone or ceramic. For example, laminate and vinyl flooring products are known, including some that imitate the look of real stone, marble, or ceramic tiles. These flooring products create an optical or visual illusion so that the surface of the tile looks like real stone, marble or ceramic or even like real wood flooring. Traditionally, however, such flooring products are manufactured so as to require that the individual tiles be installed directly next to each other, often in abutting relation, although some of these products are installed with a slight separation between them to facilitate installation on uneven floor surfaces. While this slight separation may be observable and in some cases may appear as a small seam or even as a micro groove, these types of known tiles do not offer any structure to represent or closely resemble the look and feel of a real grout line. This is also true for most existing imitation flooring products having an interconnecting mechanism to facilitate installation, such as correspondingly disposed "tongue" and "groove" structures formed along a side of a tile. In more recent imitation flooring products imitation grout lines, also referred to as faux grout lines, are created by mechanically milling one of more side edges of the tile during production, wherein material of a top layer and an underlying decorative layer is removed to exposed an edge part of the core layer acting as faux grout line. However, this cut-away of material at the tile edge(s) is laborious and leads to dust waste which is undesired from an economic and health point of view. Moreover, by exposing the core to the atmosphere, and hence to moisture and temperature variations and fouling, during daily use may easily affect the core and therefore the tile (covering) as such.

It is a first object of the invention to provide an improved surface covering element having an improved bevel and/or grout line, in particular faux grout line.

It is a second object of the invention to provide an improved surface covering element having an alternative bevel and/or grout line, in particular faux grout line.

SUMMARY OF THE INVENTION

At least one of these objects can be achieved by providing a surface covering element according to the invention, comprising: a core provided with an upper side and a lower side, a decorative top structure affixed, directly or indirectly, on said upper side of the core, said decorative top structure comprising: at least one decorative layer forming at least one décor image, a substantially transparent or translucent printed covering structure at least partially covering said decorative layer, wherein the printed covering structure comprises: a, preferably rectangularly shaped, printed center portion covering a, preferably rectangularly shaped, center portion of the decorative layer, and at least one printed peripheral portion adjacent to said center portion, and extending along a length of a side of the center portion, wherein said at least one peripheral portion covers at least one peripheral portion of the decorative layer, wherein the peripheral portion of the covering structure is recessed with respect to the center portion of the covering structure, and wherein the printed recessed peripheral portion of the covering structure represents a peripheral bevel and/or a peripheral grout line, in particular a peripheral faux grout line.

By printing a peripheral portion (edge portion) of the covering structure, either directly or indirectly, on a peripheral portion (edge portion) of the decorative layer, a three-dimensional bevel and/or grout line structure can be created, with improved freedom of design, and without having to cut-away material during the production process, which will prevent uncontrolled distribution of cut-away material (dust), which is advantageous from an economic, logistic, and health/safety point of view. Due to the increased freedom of design which is available during the printing process of the transparent and/or translucent ink, resin, or varnish onto the decorative layer, improved, and more realistic haptonomic (tactile) properties of the bevel and/or (faux) grout line can be obtained. Moreover, by printing the bevel structure and/or grout structure (formed by the peripheral portion of the covering structure) on top of the decorative layer, the decorative layer will remain in tact and can therefore contribute to the appearance of the bevel and/or (faux) grout line, which improves a realistic visual appearance of the bevel and/or (faux) grout line. The peripheral portion of the covering structure is recessed at least partially, and preferably entirely, recessed with respect to the center portion of covering structure. Hence, the average height, and often also the maximum height, of the peripheral portion of the covering structure, as measured from the decorative layer, is smaller than the average height, and often also the maximum height, of the center portion of the covering structure.

The (average) height of the center portion of the covering structure exceeds the (average) height of the peripheral portion of the covering structure, and wherein the printed peripheral portion of the covering structure represents a peripheral bevel and/or a peripheral grout line, in particular a peripheral faux grout line.

A bevel is typically a slanted and/or chamfered edge, which runs in downward direction in a direction away from the center portion of the covering surface. A bevel is typically used to make seams in between surface covering elements less visible and/or may be used to improve the decorative appearance of the surface covering element. A peripheral grout line, in particular a faux grout line, could include a bevel, and forms a recess, typically a channel or groove, at a peripheral edge (near the top surface) of the surface covering element, which closely resemble the look and feel of an actual grout line, and wherein the underlying decorative layer can be used to provide an improved depth effect and a more realistic visual appearance of the faux grout line. Said channel could have a concave cross-section, a rectangular cross-section, or a more complex cross-section. In addition to this, the printed center portion of the covering structure could also comprise at least one recessed channel representing an internal grout line, in particular an internal faux grout line. The use of one or more internal grout lines will optically the surface covering elements into a plurality of surface covering elements. The depth of the internal grout line is preferably substantially equal to the depth of the peripheral grout line. Preferably, the width of the internal grout line is substantially equal to the width of the peripheral grout line. In this case, there is no clear visual distinction between the peripheral grout line(s) (external grout line(s)) and the internal grout line(s). In case the printed center portion of the covering structure comprises a plurality of internal grout lines, typically formed by recessed channels, these grout lines could have different orientations and could, for example, intersect each other and/or could have a parallel orientation.

Typically, the height of at least a part of the printed peripheral portion of the covering structure decreases in a direction away from the printed center portion of the covering structure. This can, for example, be a gradual (continuous) decrease and/or a step-like decrease of the height. It is for example imaginable that a part of the peripheral portion of the covering structure, which is directly connected to the center portion of the covering structure, has a chamfered (inclined) top surface, acting like a bevel, while a more distant part of the peripheral portion of the covering structure could have a curved shape, and/or could have an orientation which is parallel and/or perpendicular to the plane defined by the core. Preferably, at least a part of the peripheral portion of the covering structure has a substantially flat top surface. Preferably, at least a part of the peripheral portion of the covering structure has a curved top surface. Preferably, at least a part of the peripheral portion of the covering structure has a top surface which is substantially parallel to a plane defined by the core. Preferably, at least a part of the peripheral portion of the covering structure has a textured top surface.

The covering structure is preferably an integrally formed covering structure, preferably formed during a single pass printing step. This means that both the peripheral portion(s) and the center portion of the covering structure are made out of the same layer. This will prevent the present of vulnerable and undesired seams in between each peripheral portion and the center portion of the surface covering element.

The transition between the center portion of the covering structure and the peripheral portion of the covering structure is preferably defined by a sharp edge. This sharp edge may for example enclose a 90 degrees angle, a 30 degrees angle, a 45 degrees angle, a 60 degrees angle, or any other angle between 0 and 90 degrees.

Preferably, the covering structure comprises a plurality of printed peripheral portions adjacent to the center portion of the covering structure, the peripheral portion extending along a length of different sides of the center portion, wherein at least one, and preferably each, peripheral portion covers at least one peripheral portion of the decorative layer. Here, it could be preferred that only two adjacent edges of the surface covering elements are provided with a printed peripheral portion. However, it is also imaginable that all edges, typically all four edges, of the surface covering element are provided with a printed peripheral portion of the covering element.

The maximum height difference between a lowest region of the peripheral portion of the covering structure and an highest region of the center portion of the covering structure is preferably situated between 200 and 800 micron, preferably between 200 and 500 micron. This restricted depth (height) saves material and facilitates the cleanability of the recessed peripheral portion during use.

The printed peripheral portion of the covering structure is preferably formed by at least one, at least partially cured layer provided with at least one indented zone, in particular a chemically embossed indented zone, extending in longitudinal direction of the peripheral portion, and/or at least one at least partially cured elevated pattern layer formed by at least one elevated zone extending in longitudinal direction of the peripheral portion. This printing process could be considered as a printing process where an embossed structure is created to eventually form the bevel(s) and/or the grout line(s). One could say that applying at least one, at least partially cured layer provided with at least one indented zone, in particular a chemically embossed indented zone, could be considered as a negative embossing step, as firstly a (initially liquid) base layer is applied which is position-selectively reduced in height in a subsequent step by means of mechanically pressing and/or by means of a reactive chemical substance. The application of at least one at least partially cured elevated pattern layer formed by at least one elevated zone can be considered as a positive embossing step, as an embossed structure is created (built), from bottom to top, onto, either directly or indirectly, the decorative layer. The elevated zone could be printed on the decorative layer. A combination of this negative embossing step and (successive) positive embossing step is also imaginable in order to form the peripheral portion(s) of the covering structure. The elevated zone could, for example, be printed on said at least partially cured layer provided with at least one indented zone.

Preferably, at least one peripheral portion of the decorative layer is provided with a different print compared to the print of the center portion of the decorative layer. This different print could for example be a different colour, for example grey, to imitate real grouts as realistic as possible. However, it is also imaginable that at least one peripheral portion of the decorative layer is provided with a darker (decorative) print compared to the (decorative) print of the center portion of the decorative layer. This darker print could lead to an enhanced depth effect, and therefore a more realistic The center portion of the covering structure is preferably an embossed center portion. This will provide the center portion a three-dimensional structure, also referred to as embossing structure. The three-dimensional embossing structure preferably comprises one or more printed embossing layers, wherein each embossing layer is substantially composed of (embossing) ink, as will be elucidated below in more detail. Preferably, roughening of the texture of at least of part of the upper surface of the embossing structure is taking place when the embossing ink is partially cured, hence partially (still) soft, which allows the embossing ink to be mechanically deformed and/or mechanically treated relatively easily. Typically, the roughened texture is provided to at least a part of the upper surface of the embossing structure by means of mechanical interaction with said upper surface, preferably by making use of one or more (rotating) brush rollers, such as metal, in particular steel, brush rollers. During this mechanical treatment of at least a part of the upper surface of the embossing structure, material will be removed from and/or displaced of the initial embossing structure, leading to a roughening (sharpening) of the texture of the embossing structure. This roughening effect leads to a relief which comes closer to the look and feel of natural wood nerves, typically also having sharp edges rather than smooth, rounded edges, which improves the visual appearance and/or haptonomic (tactile) properties of the surface covering element according to the invention. In this context it has to be taken into account that a printed embossing structure provides infinite possibilities and flexibility to design a desired embossing structure, but the drawback and risk of this printed embossing structure is that this embossing structure is printed by using a liquid ink, which could relatively easily flow (to some extent) directly after printing, which easily leads to a more smooth (rounded) texture than intended. This drawback can be overcome by (mechanically) roughening the printed embossing—preferably soon/directly—after printing to get a more realistic embossing structure (embossing texture) and/or an embossing structure being more in line with the embossing structure as initially intended/desired. Typically, the roughened texture of the upper surface of the embossing structure comprises a plurality of adjacent (connecting), typically substantially flat, surface facets mutually enclosing angle. This lead to one or more sharp edges, which typically improves the look and feel of the surface covering element as experienced by a user. The roughened texture comprises a plurality of scratches and/or grooves. These can e.g. be realized by means of the mechanical brush, in particular a brush roller. It could be preferred that the recessed peripheral portion(s) of the covering structure is/are free any of (mechanically) roughened surface.

The surface covering element is preferably a board, a cladding, a sheet, a tile, or a panel, such as a floor panel, ceiling panel, wall panel, or furniture covering panel. These panels are typically square or rectangular. It is imaginable that surface covering element is a strip (or sheet) provided as a roll to be laid out by unrolling from said roll. The length of such a strip is typically between 4 and 30 meter. In the context of this document the expressions "surface covering element" and "panel" are interchangeable.

It is preferred in case the embossing structure (i.e. the embossed center portion of the covering structure) comprises at least one thixotropic agent. Typically this thixotropic agent makes part of the ink composition for forming the printed embossing structure. Thixotropy is a time-dependent shear thinning property. This allows the embossing ink used to build (at least a part of) the embossing structure to be thick or viscous under static conditions, wherein the viscosity of the ink will decrease upon exertion of mechanical pressure or force allowing the ink to flow and to be deformed more easily. After release of the mechanical pressure or force, the ink returns to a more viscous state. A possible ink composition to be used as embossing ink may comprise: a) at least one organic and/or water-based ink vehicle, (b) at least one ethanolamine compound, and (c) at least one color-imparting material, such as a pigment. The ethanolamine compound(s) is/are combined with the organic ink vehicle and pigment in sufficient concentration to provide a composition which exhibits desirable thixotropic properties as well as physical, chemical, and visual/colour characteristics suited to the intended application. The organic ink vehicles usable in ink compositions of the present invention include various (a) ink oils and (b) organic resins and/or combinations thereof. Examples of ink oils which are preferably used in the present invention include naphthenic ink oils. The ethanolamine thixotropic agents which may be used in the present invention include monoethanolamine, diethanolamine, and/or triethanolamine. Of these, triethanolamine is presently preferred for use as a thixotropic additive in oil and/or resin-based printing ink compositions. In addition to their ability to impart desirable rehological properties, the inclusion of ethanolamine compounds, such as TEA, within the ink compositions of the present invention has been found to bring about improved rub resistance of the applied printing ink. Such improvement in rub resistance is identified as an additional advantage to be gained by incorporating the ethanolamine compounds of the present invention into ink compositions used in applications wherein rub-off is a typical problem. The colour-imparting additives employable in ink compositions of the present invention include various pigments and/or pigment-containing pastes. Pre-dispursed pigment pastes generally comprise one or more colored pigments dispursed in a vehicle and/or solvent. The vehicle(s) employed in such pre-dispursed pigment paste may comprise one or more of the organic ink vehicles described herein as basic components of ink compositions of the present invention and/or other vehicles which differ from the above-described organic ink vehicles. The embossing ink compositions which may be used to realize a surface covering element according to the present invention may be prepared at room temperature without the addition of extraneous heat. Such printing ink compositions are known to exhibit desirable thixotropy as well as increased rub resistance. Other thixotropic agents that may be used in the embossing ink to be used are, for example fumed silica and/or clay-type thixotropic agents.

Preferably, the entire upper surface of the embossing structure is provided with a roughened texture. Preferably, each roughened part of the upper surface of the embossing structure is roughened a plurality of times, more preferably by applying a plurality of successive mechanical roughening actions. Each roughening action can roughen the surface of the embossing structure in the same direction, but it is also conceivable that at least two roughening actions treat the upper surface of the embossing structure in mutually different directions.

Preferably, the embossing structure (i.e. the embossed center portion of the covering structure) comprises: at least one, at least partially cured base layer provided with a plurality of indentations, and/or at least one at least partially cured elevated pattern layer formed by a plurality of elevations printed on top of said base layer. The roughened texture is provided both to at least a part of the base layer and to at least a part of the pattern layer. It is also conceivable that the peripheral portion(s) of the covering structure is/are provided with the same type of embossing.

The surface covering element according to invention preferably comprises a multi-layer embossing structure which comprises at least one negative embossing layer, wherein indentations (recesses) are applied in a base layer, and at least one positive embossing layer, wherein elevations (protrusions) are provided on top of said negative embossing layer. This results in a more pronounced (rough and hilly) embossing structure, wherein relatively deep embossings may be created, which leads to a more realistic appearance of the surface covering element as such. Due to the relatively deep embossings which may be created by applying the multi-level layered embossing structure, a more realistic light effect as well as a better depth effect can be obtained, wherein the colours of the décor image are typically better perceptible. Typically, an upper side of the base layer defines an embossing base level, and wherein the indentations and at least a part and/or at least a number of the elevations are situated at opposite sides of said embossing base level. It is also imaginable that the indentations and at least a part and/or at least a number of the elevations are situated at the same side of said base level.

Typically, a part of the base layer is provided with said plurality of indentations, and wherein another part of the base layer is free of indentations. Hence, in this embodiment, the base layer is merely partially embossed. The elevations, of at least a part thereof and/or a number thereof, are preferably printed on the part of the base layer which is free of indentations, which leads to an increased depth effect of the embossing structure as such.

It is imaginable that the plurality of indentations of the base layer forms a discontinuous and/or a continuous indentation pattern. It is also imaginable that the plurality of indentations of the base layers forms a regular indentation pattern. Typically, the indentation pattern to be realized is strongly, or even completely, dependent on at least one décor image of the decorative layer.

Preferably, the base layer is a printed base layer. This means that the base layer, initially in liquid state, is printed either directly or indirectly on top of the decorative layer. One or more indentations may be provided in the base layer when the base layer is still in liquid state and/or one or more indentations may be provided in the base layer during and/or after curing (solidifying) the base layer. Providing one or more indentations in the liquid base layer is preferably done by means of chemically embossing. To this end, preferably (small) droplets of an embossing liquid are position-selectively printed (sprayed) onto the liquid base layer to cause a chemical reaction between the material of the printed droplets and the still liquid base layer, wherein the subsequent reaction product changes the structure at this location of the base layer optically and/or haptically. Providing one or more indentations in the base layer during or after curing may be done by either chemical embossing (as described above) and/or by mechanical embossing e.g. by using a laser or particle beam, such as a water beam.

Preferably, the indentations provided in the base layer have a depth situated in between 2 micron and 100 micron, preferably situated in between 3 micron and 50 micron. Preferably, the elevations of the elevated pattern layer have a height situated in between 2 micron and 500 micron, preferably situated in between 3 micron and 300 micron. The total embossing depth is determined by the sum of the greatest indentation depth and the greatest elevation height. In case a plurality of base layers and/or a plurality of elevated pattern layers is applied, an increase of the total embossing depth can be achieved.

In a preferred embodiment, and if applied, at least a part of the indentations of the base layer of the center portion of the covering structure is aligned in register with at least a part of at least one decor image formed by the decorative layer, in particular the printed decorative layer. Preferably, and if applied, at least a part of the elevations of the elevated pattern layer of the center portion of the covering structure is aligned in register with at least a part of at least one decor image formed by the decorative print layer. More preferably, both at least a part of the indentations of the base layer is aligned in register with at least a part of at least one decor image formed by the decorative print layer and at least a part of the elevations of the elevated pattern layer is aligned in register with at least a part of at least one decor image formed by the decorative print layer. This leads to a dual embossing in register, also referred to a dual synchronised embossing. By applying such an alignment in register a very realistic and/or artistic design and appearance and tactile properties of the surface covering element can be realized. The décor image may be formed by a wood (nerve) pattern, such as an oak (nerve) pattern. It is also conceivable that the peripheral portion(s) of the covering structure is/are provided with the same type of (mono or dual synchronized) embossing in register. The embossed structure, in particular due to the roughened texture thereof, can match this wood (nerve) pattern, resulting in a very realistic look and feel appearance of the surface covering element according to the invention. However, instead of wood (nerve) patterns, it is well thinkable that the décor image represents another kind of pattern, such as, for example, a customized picture and/or a mosaic pattern or tile pattern. In case of a mosaic pattern or tile pattern, artificial tiles may be depicted which are aesthetically separated by one or more grouts. Here, the embossing structure applied may comprise a base layer having thicker layer parts covering the artificial tiles and thinner layer parts covering to one or more grouts. Here, it is also imaginable that elevations of the elevated pattern are predominantly or merely covering the artificial tiles and less or not at all the artificial tiles. In this manner, a realistic surface relief can be realized which is practically equal to the surface relief obtained when using real tiles and grouts.

It is imaginable that at least one additional decorative print layer is situated in at least one base layer and at least one elevated pattern layer. In this manner a multi-layer decorative pattern can be realized. This further increases the freedom of design of creating an decorative top structure including the embossing structure and the plurality of decorative layers, and this, for example, also allows to create a three-dimensional effect to the overall décor image(s). It is also imaginable that a coloured coating is provided in the indentations and onto the base layer. This coloured coating may be considered as additional decorative print layer.

Preferably, the grammage of the base layer is at least 40 $g/m^2$, preferably at least 50 $g/m^2$. Typically, the base layer is made of a radiation-curing material. Preferably, the base layer, at least in the initial liquid state, is made of at least one resin selected from the group consisting of: epoxy acrylates, polyester acrylates, polyether acrylates, amino acrylates, silicone acrylates, urethane acrylates, polyisoprene acrylates, polybutadiene acrylates and acrylate monomers. The term acrylates, also referred to as acrylic resin, includes both acrylate resins and methacrylate resins. The previously described resins are associated in that they polymerize and harden by virtue of the electromagnetic energy irradiated by e.g. a laser, typically a UV laser, an infrared source, and/or a mercury (Hg) light source. In a preferred embodiment, (meth)acrylate resin has a high solid content, for example equal to 20-30% by weight with respect to the weight of the resin, which typically leads to a desired volume increase of the base layer. Optionally, the base layer may comprise one or more photo-initiators to facilitate curing of the base layer. The (transparent and/or translucent) base layer may comprise fillers, such as (i) aluminium oxide, to increase the abrasion resistance thereof, (ii) talc to modify the rheology thereof, (iii) silica to reduce the brilliance thereof, calcium carbonate and/or (iv) other additives, such as rheology modifiers, and/or colorants. Optionally, the base layer may comprise silicones which are capable of increasing the depth of the embossing. Typically, silicones are added in an amount of 0.01-20% by weight of the base layer, preferably in an amount of 0.01% to 10%, more preferably in an amount of 0.01% to 2% by weight of the base layer. Suitable silicones include, for example, silicones, silicone polyethers, silicone acrylates, and silicone polyether acrylates.

Preferably, the base layer, at least in the initial liquid state, comprises propylidynetrimethanol, ethoxylated, esters with acrylic acid, and preferably also N-ethylamine, more preferably N-ethylethanamine. These products typically react with each other leading to an amine modified acrylic oligomer which can be polymerised by free radicals. And this latter property is used for radiation-curing of the base layer.

The base layer, at least in the initial liquid state, preferably comprises an epoxy acrylate oligomer, more preferably bisphenol A epoxy diacrylate. Bisphenol A epoxy diacrylate is a colourless liquid. This epoxy acrylate oligomer provides high gloss, imparts excellent reactivity and features outstanding chemical and mechanical fastness properties for the radiation-curable base layer.

Preferably, the base layer, at least in liquid state, comprises at least diacrylate, preferably at least one diacrylate chosen from the group consisting of: tricyclodecanedimethanol diacrylate; 1,6-hexanediol diacrylate; hexamethylene diacrylate; oxybis(methyl-2,1-ethanediyl) diacrylate; and 3-methyl 1,5-pentanediol diacrylate. These di-functional acrylic monomers are very reactive and are typically printed and/or sprayed, as embossing liquid (embossing ink), onto the original based layer (in liquid state) in order to create, position-selectively, indentations in the base layer. Droplets of this embossing ink can be applied onto the base layer in a very accurate manner, typically with a resolution of approximately 500-1,000 dpi (or more).

The grammage of the elevated pattern layer is at least 60 $g/m^2$, preferably at least 70 $g/m^2$. The grammage of the elevated pattern layer is preferably higher than the grammage of the base layer. The elevated pattern layer preferably comprises acrylic resin. More preferably, the elevated pattern layer, at least in liquid state, comprises biacrylate, preferably tripropylene glycol biacrylate. The elevated pattern layer can be printed and/or sprayed, position-selectively, onto the base layer. This printing process is preferably also executed in a very accurate manner, typically with a resolution of approximately 500-1,000 dpi (or more).

The covering structure is preferably at least partially covered by a lacquer layer (wear layer). The lacquer layer can comprise any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also comprise an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance and other properties of the product. Other organic polymers including polyvinyl chloride resins or other polymers such as vinyl resins, and a suitable amount of plasticizing agent and other processing additives can be included, as needed. In an embodiment of a surface covering element according to the invention, at least at least a part of the indentations of the base layer is left uncovered by the lacquer layer. In this manner, a further embossing effect (relief effect) can be achieved, and, moreover, glossy and matt areas may be created in this manner, which may further contribute to a desired aesthetical appearance of the surface covering element as such. Here, for example, in case the décor image is formed by artificial tiles separated by grouts, the artificial tiles may be covered by the lacquer layer to provide these tiles a glossy effect, while the grouts are left substantially uncovered by the lacquer layer to maintain a more matt appearance.

It is imaginable that at least a part of at least one decorative layer is printed, preferably digitally printed, directly onto the upper side of the core. It is also imaginable that the upper side of the core is provided with at least one carrier layer, preferably formed by at least one primer or a film, wherein at least a part of the decorative layer is printed, preferably digitally printed, directly onto the carrier layer. The carrier layer can be affixed directly or indirectly (via one or more intermediate layers) onto the core. In case a primer is applied, then it is imaginable to apply at least two different primers, such as a glossy primer and a matt primer, which are position-selectively applied, side by side (adjacently), onto the core, preferably aligned in register with the decorative print layer to be applied on top of said primers. Also in this manner, a glossy effect and a matt effect can be realized at position-selective locations which can further contribute to a desired, realistic and/or artificial look (and feel) of the surface covering element as such. Alternatively, though this is commonly less preferred, a paper layer or thermoplastic film provided with a décor image may act as decorative layer. This separate layer will typically have to be attached first, either directly or indirectly, to the core, after which the covering structure is applied.

In an embodiment of the surface covering element according to the invention, in between the printed decorative layer and the covering structure at least one intermediate layer is situated. This intermediate layer is normally transparent, preferably very transparent, and/or translucent. Preferably, at least one intermediate layer is formed by a transparent or translucent, light-reflective thermoplastic layer, preferably a polyester layer, more preferably a polyethylene terephthalate layer (PET layer). This light-reflective thermoplastic layer acts as protective layer to protect the décor image against degradation due to exposure to daylight (or artificial light). Moreover, this light-reflective thermoplastic layer also prevents heating of the surface covering element due to exposure to daylight (or artificial light) and therefore counteracts thermal action (expansion and shrinkage), which is in favour of the durability and reliability of both the surface covering element as such and a floor covering consisting of a plurality of, preferably mutually coupled, surface covering elements. The light-reflective thermoplastic layer is preferably glued onto the printed decorative layer, more preferably by using a hot melt glue. The base layer may be applied directly on top of the light-reflective thermoplastic layer.

Typically, a backing layer is affixed to a lower side of the core. Non-limiting examples of materials whereof the backing layer can be made of are polyethylene, cork, polyurethane and ethylene-vinyl acetate. The thickness of a polyethylene backing layer is for example typically 2 mm or smaller. The backing layer commonly provides additional robustness and impact resistances to each tile as such, which increases the durability of the tiles. Moreover, the (flexible) backing layer may increase the acoustic (sound-dampening) properties of the surface covering element.

In a preferred embodiment, a first panel edge (a first surface covering element edge) comprises a first coupling profile, and a second panel edge (a second surface covering element edge), preferably opposite to the first panel edge, comprising a second coupling profile being designed to engage interlockingly with said first coupling profile of an adjacent surface covering element, both in horizontal direction and in vertical direction, wherein the first coupling profile and the second coupling profile are preferably configured such that two of such surface covering elements can be coupled to each other by means of a lowering movement (fold-down movement). In case the surface covering element is rectangular, then the first panel edge and second panel edge are typically situated at opposite short edges of the surface covering element. The surface covering element preferably also comprises at least one third coupling profile and at least one fourth coupling profile located respectively at a third panel edge and a fourth panel edge, wherein the third coupling profile comprises: a sideward tongue extending in a direction substantially parallel to the upper side of the core, at least one second downward flank lying at a distance from the sideward tongue, and a second downward groove formed between the sideward tongue and the second downward flank, wherein the fourth coupling profile comprises: a third groove configured for accommodating at least a part of the sideward tongue of the third coupling profile of an adjacent surface covering element, said third groove being defined by an upper lip and a lower lip, wherein said lower lip is provided with an upward locking element, wherein the third coupling profile and the fourth coupling profile are configured such that two of such surface covering elements can be coupled to each other by means of a turning movement (angling down movement), wherein, in coupled condition: at least a part of the sideward tongue of a first surface covering element is inserted into the third groove of an adjacent, second surface covering element, and wherein at least a part of the upward locking element of said second surface covering element is inserted into the second downward groove of said first surface covering element.

The core may be flexible, semi-rigid or substantially rigid. The core may be solid or at least partially foamed. The core may comprise at least one polymer selected from the group consisting of: ethylene vinyl acetate (EVA), polyurethane (PU), polyethylene (PE), polypropylene (PP), polystyrene (PS), polyvinylchloride (PVC), polyethylene terephthalate (PET), Polyisocyanurate (PR), or mixtures thereof. The core may comprise at least one wood-based material. The core may comprise at least one composite material of at least one polymeric material and at least one non-polymeric material. The at least one non-polymeric material is preferably selected from the group consisting of: talc, chalk, wood, calcium carbonate, and a mineral filler. The core may comprise magnesium oxide and/or magnesium hydroxide. The upper side of the core is preferably substantially flat.

The invention also relates to a surface covering element covering, such as a panel covering, in particular floor covering, ceiling covering, or wall covering, consisting of a plurality of, preferably mutually coupled, surface covering elements according to the invention. Here, it is imaginable that at least two surface covering elements have a distinctive décor image, wherein each décor image represents a partial image, and wherein the combination of said décor images together form a single image (picture or photo). This single image may continue within the peripheral portion(s) of the covering structure, or may—if desired—be interrupted within said peripheral portion(s). The invention further relates to a method of producing a decorative surface covering element according to the invention, comprising the steps of: A) forming at least one decorative layer onto the upper side of the core by means of printing, preferably digital printing, B) applying a liquid base layer on at least a part of at least one décor image formed during step A) to form a center portion and at least one peripheral portion of the covering structure, position-selectively printing of a plurality of embossing droplets on the still liquid base layer in a manner, that the thickness of the base layer changes on the positions where the embossing droplets are spayed on, such that at these positions indentations are formed in the liquid base layer, and such that the average height of the center portion of the covering structure exceeds the average height of the peripheral portion of the covering structure, wherein the printed peripheral portion of the covering structure is formed as peripheral bevel and/or a peripheral grout line, in particular a peripheral faux grout line, C) at least partially curing said base layer provided with said indentations, D) optionally, position-selectively printing an elevated pattern layer formed by a plurality elevations on at least a part of the covering structure, preferably after at least partially curing of the covering structure during step C), and partially curing said pattern layer, wherein said base layer and said pattern layer, if applied together form the embossed covering structure, and E) optionally mechanically treating at least a part of the upper surface of the embossed covering structure to provide a roughened texture to the embossed structure.

During step E) material is preferably removed from and/or deformed of the embossing structure. In order to keep the base layer sufficiently hard (rigid) to prevent easy flow and to keep the base layer sufficiently soft to allow easy roughening of the base layer, it is advantageous in case during step C) and/or step D) between 60 and 90% of the base layer is cured. The same applies to the pattern layer. During step E), preferably at least a part of the upper surface of the covering structure is treated by using at least one axially rotating brush roller, preferably a metal brush roller, in particular a steel brush roller. The rotation speed of these rollers may vary, but is preferably between 400 and 800 revolutions per minute. The diameter of the roller may vary, but is preferably situated between 20 and 40 centimeter. Preferably, during step E) at least a part of the upper surface of the embossing structure is treated at least two times by using at least two successive axially rotating brush rollers, preferably metal brush rollers, in particular steel brush rollers. Preferably, during step E) at least two brush rollers are rotated in opposite directions. Preferably, each roller is accommodated in an individual or shared cage or housing to prevent uncontrolled distribution of cut-away material (dust), and more preferably this cage or housing is connected to a vacuum exhaust conduit to remove as much as cut-away material as possible during the brushing action.

It is advantageous in case the method comprises step F) comprising the step of mechanical cleaning the surface covering element, in particular the embossing structure, subsequent to executing step E). This cleaning action according to step F) can be performed mechanically, for example by means of a cleaning brush, in particular a cleaning brush roller, such as a textile roller and/or a nylon roller. This cleaning action is normally primarily applied in order to remove (evacuate) cut-away material (dust) from the embossing structure during step E).

Preferably, the method comprises step G) comprising the step of cutting the surface covering element into a plurality of smaller surface covering elements, like for example planks or panels. During step B), preferably at least one shared peripheral portion is created which is enclosed by at least two center portions of two surface elements to be formed, and wherein during step G) each shared peripheral portion is cut along its length to form a plurality of surface covering elements each having at least one peripheral portion located at its side edge(s Preferably, the method comprises step H) comprising the profiling at least one edge of at least one surface covering element and/or at least one panel or plank formed during step G).

Further advantages and embodiments of the surface covering element have been discussed above already in an extensive manner. During step C) the embossing droplets are preferably printed onto the liquid base layer according to a first digital template, which is aligned in register with at least a part of at least one décor image formed during step A). During step D) the elevated pattern is preferably printed onto the base layer according to a second digital template, which is aligned in register with at least a part of at least one décor image formed during step A). More preferably, the first digital template differs from the second digital template. Preferably, curing of the base layer according to step C) and/or curing of the pattern layer according to step D) is performed of radiation curing, preferably by means of UV radiation and/or electron radiation and/or IR radiation and/or monochromatic radiation. Step A), and/or step B), and/or step D) may be performed by using one of more digital printers, in particular inkjet printers.

BRIEF DESCRIPTION OF THE DRAWINGS

The invention will be elucidated on the basis of non-limitative exemplary embodiments shown in the following figures:

FIG. 1*d* shows indentations formed in the liquid base layer at the positions where the embossing droplets are sprayed on;

DESCRIPTION OF THE INVENTION

Figure 1A:
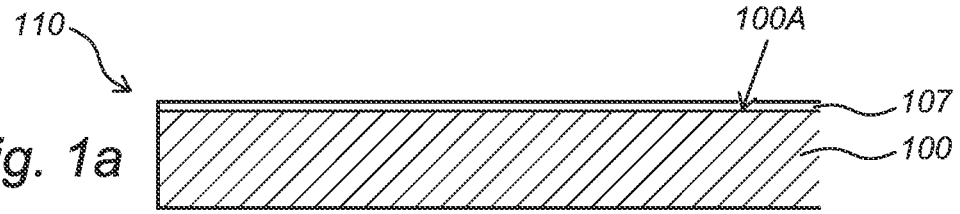
FIG. 1*a* shows a schematic representation of a cross section of a decorative panel as an example of a surface covering element according to the invention.
Figure 1B:
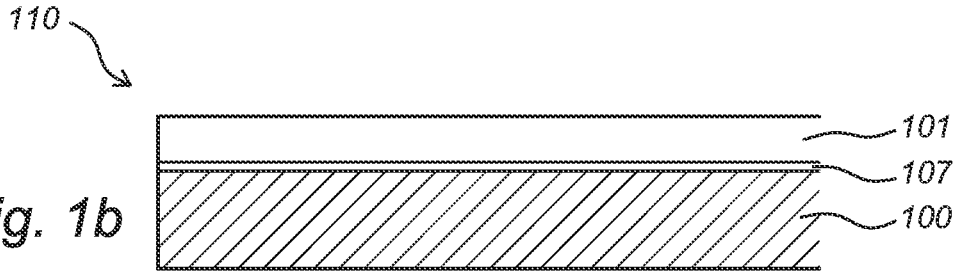
FIG. 1*b* shows that a liquid base layer is applied on the décor image formed at the upper side of the panel.
Figure 1C:
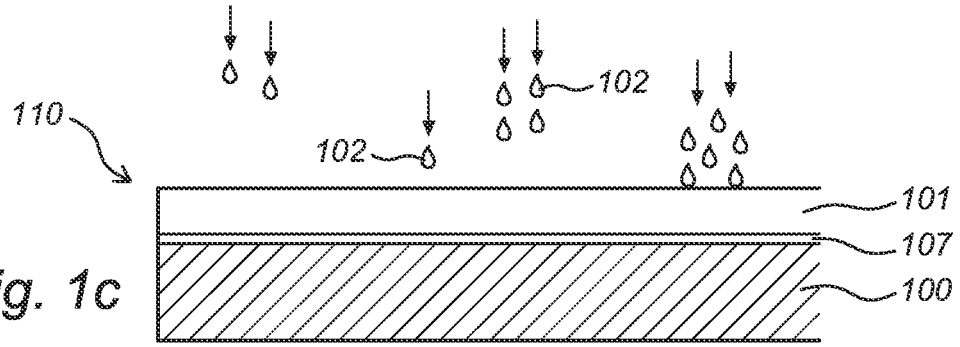
FIG. 1*c* show that a plurality of embossing droplets is position-selectively printed on the still liquid base layer.
Figure 1D:
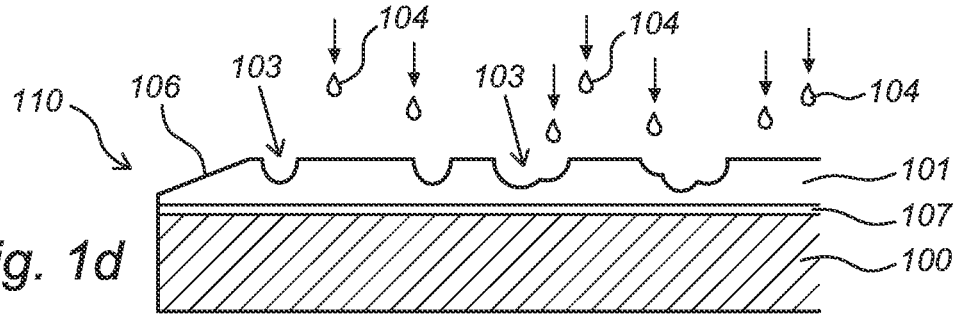
Figure 1E:
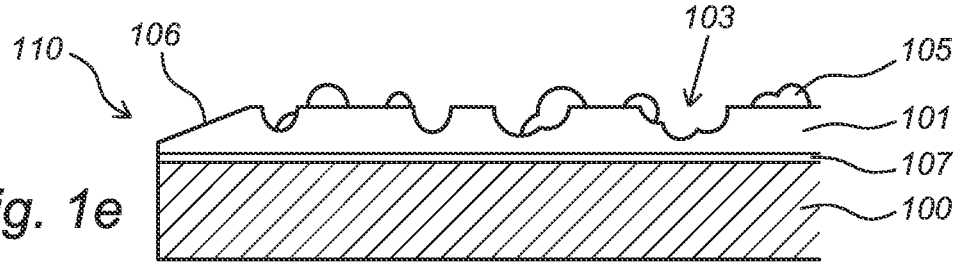
FIG. 1*e* shows a plurality of elevations printed on top of said base layer; Figure if shows the embossing structure mechanically treated by means of a plurality of successively oriented rotating cylindrical brush rollers.
Figure 1F:
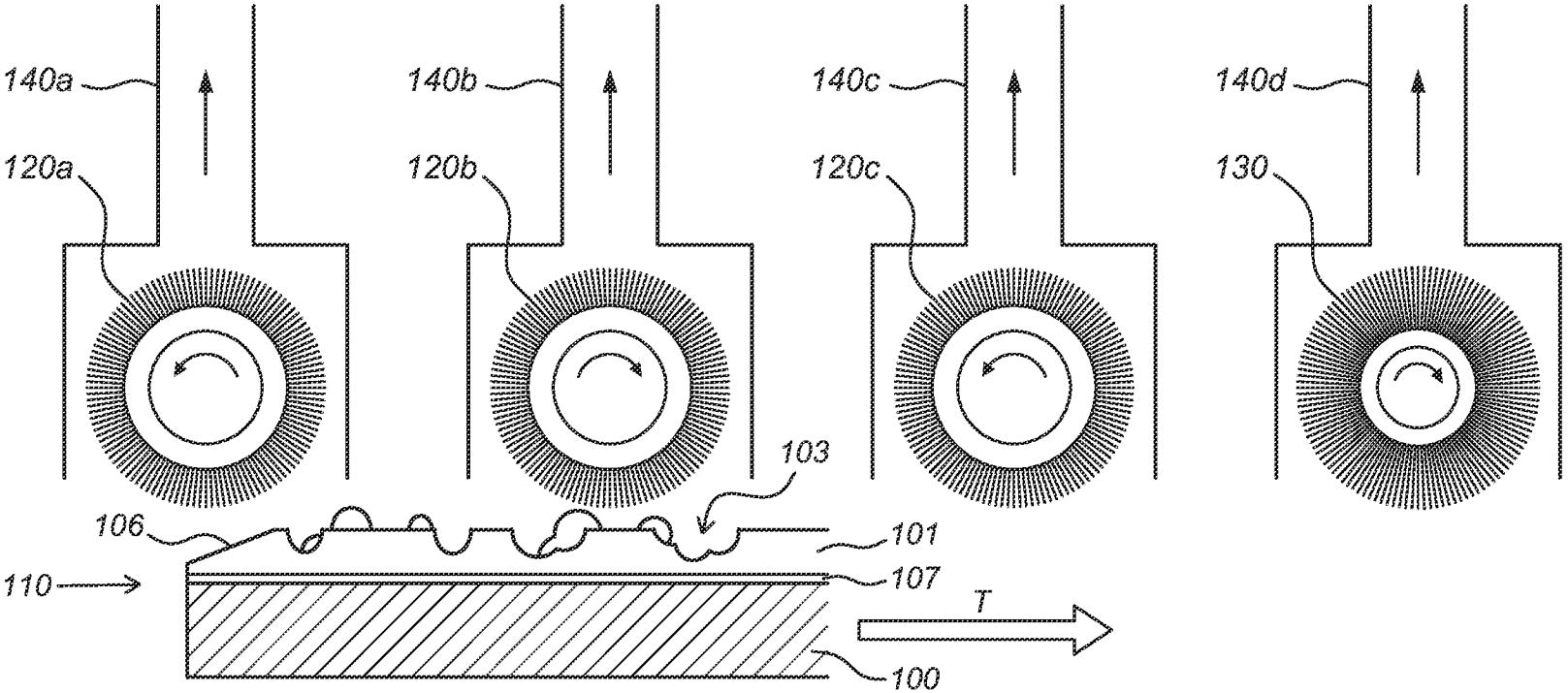
Figure 1G:
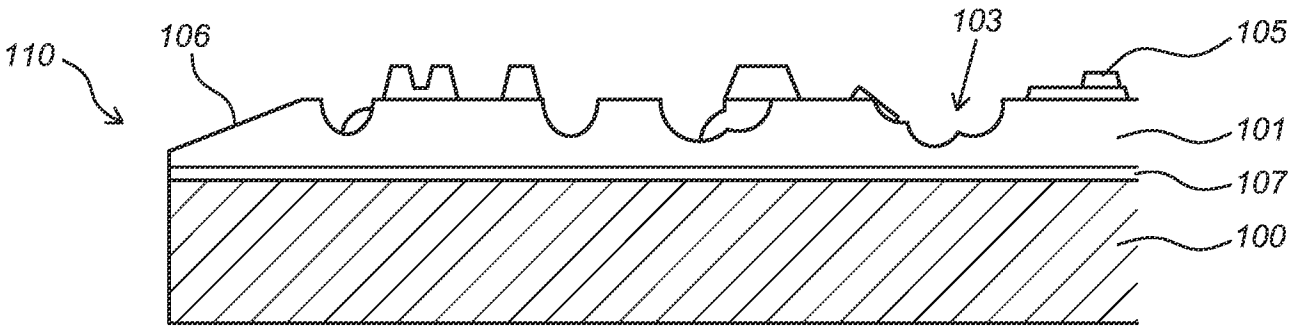
FIG. 1*g* shows a roughened texture of the embossing structure.

FIGS. 1*a*-1*g* show subsequent steps of a method according to the present invention. FIG. 1*a* shows a schematic representation of a cross section of a decorative panel (110) as an example of a surface covering element according to the invention. The figure shows the core (100) of the panel (110). The core (100) is typically substantially rigid, and may possibly comprises at least one polymer and/or at least one wood-based material. A decorative layer (107), in particular a décor image, is formed, preferably by means of digital printing, onto the upper side (100A) of the core (100) by means of printing, in particular digital printing. FIG. 1*b* show that a liquid base layer (101) is applied on the décor image formed at the upper side (100A) of the panel (110). The liquid forming the liquid base layer (101) is for example a UV sealer. The liquid base layer (101) generally has a relatively high surface tension in order to allow precise embossing in the liquid base layer (101). FIG. 1*c* show that a plurality of embossing droplets (102) is position-selectively printed on the still liquid base layer (101). This is done such that the thickness of the base layer (101) changes on the positions where the embossing droplets (102) are spayed on. FIG. 1*d* shows that this results in that positions indentations (103) are formed in the liquid base layer (101) at the positions where the embossing droplets (102) are sprayed on. The base layer (101) is at least partially cured after the base layer (101) is provided with said indentations (103). Subsequently an elevated pattern layer is formed by position-selectively printing of a plurality elevations on the base layer (101). The elevation droplets (104) applied onto the panel (110) are shown in FIG. 1*d*. The pattern layer obtained via the position-selectively printing of the elevations (105) is subsequently at least partially cured. Preferably, the embossing droplets (102) and/or the elevation droplets (104) have a surface tension which is higher than the surface tension of the liquid base layer (101). Optionally, one or more finishing layers (not shown) can be applied to the panel (110). Via the steps shown in FIGS. 1*a*-1*e*, a decorative panel (110) is obtained, comprising a core (100) and a decorative top structure affixed on the upper side (100A) of the core (100). The decorative top structure comprises a decorative print layer forming at least one décor image and a substantially transparent or translucent three-dimensional embossing structure at least partially covering said print layer. The embossing structure is a multi-layer embossing structure which comprises a base layer (101) provided with a plurality of indentations (103) and an elevated pattern layer formed by a plurality of elevations (105) printed on top of said base layer (101). It can be seen that the indentations (103) and the elevations (105) can overlap, such that a panel (110) having an irregular height structure is obtained. The plurality of indentations (103) of the base layer (101) forms a discontinuous indentation pattern. At least one side edge of the panel (110) the base layer is provided with an inclined smooth or textured surface, which forms a bevel (106). Hence, the bevel (106) is formed by the printed base layer (101), wherein the decorative layer (107) extends underneath said bevel (106) and thus remains intact. The panel (110) may possibly comprise multiple coupling profiles for coupling multiple panels (110). The panel (110) may also comprise a backing layer (not shown) affixed to a lower side of the core (100). In figure if it is shown that the embossing structure is mechanically treated by means of a plurality of successively oriented rotating cylindrical brush rollers (120*a*, 120*b*, 120*c*), wherein adjacent brush rollers (120*a*, 120*b*, 120*c*) axially rotate in opposite directions. The brush rollers (120*a*, 120*b*, 120*c*) typically have relatively sturdy and/or rigid brush wires, preferably at least partially made of metal, more preferably of steel and/or a composite of steel and carbon. The diameter of the brush rollers (120*a*, 120*b*, 120*c*) in this exemplary embodiment is substantially 30 centimeter. The rotation speed of the brush rollers (120*a*, 120*b*, 120*c*) is typically between 550 and 650 revolutions per minute (rpm), and is preferably substantially equal to 600 rpm. The brush rollers (120*a*, 120*b*, 120*c*) are used to transform the (complete) initially smooth texture of the upper surface of the panel (110) into a more roughened texture of the upper surface of the panel (110). This roughened texture of the embossing structure has typically more sharp edges, and has a look and feel appearance which comes close(r) to natural wood nerves, as shown in more detail in FIG. 1*g*. This is in particular advantageous in case the décor image also constitutes a wood nerve pattern, preferably a wood nerve pattern, wherein the decorated wood nerves are in register (in line) with the embossed wood nerves. During this mechanical action, material will be removed from the embossing structure, and optionally also from an intermediate transparent layer (if applied) situation in between the embossing structure and the décor image, which material will be released as dust particles. To evacuate at least a part of the dust particles created during this mechanical brushing action (roughening action), each brush roller (120*a*, 120*b*, 120*c*) is enclosed by a cover (140*a*, 140*b*, 140*c*), also referred to as housing or cage, which cover (140*a*, 140*b*, 140*c*) is connected to a vacuum system (not shown). It can be chosen that brush rollers (120*a*, 120*b*, 120*c*) also brush the bevel(s) (106) or that the brush rollers substantially keep distance from the bevel(s) (106) in order to leave the bevel(s) (106) untouched. During further displacement of the panel (110) in a transport direction T, the panel (110) will pass an axially rotating cylindrical cleaning brush roller having more soft wires, such as textile and/or nylon wires, to remove further dust particles from the panel (110). Typically after roughening and cleaning, the panel (110) will be cut into smaller panels, and will be profiled at two or four panel edges (not shown), wherein the one or more bevels (106) may or may not be shortened (i.e. reduced in width and/or length).

Figure 2A:
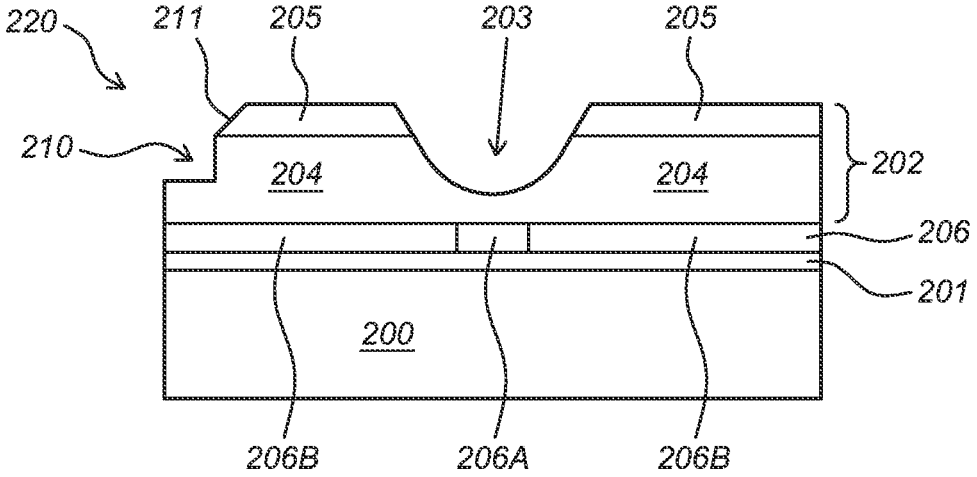
FIG. 2*a* shows a schematic representation of a side view of another example of a decorative panel according to the present invention.
Figure 2B:
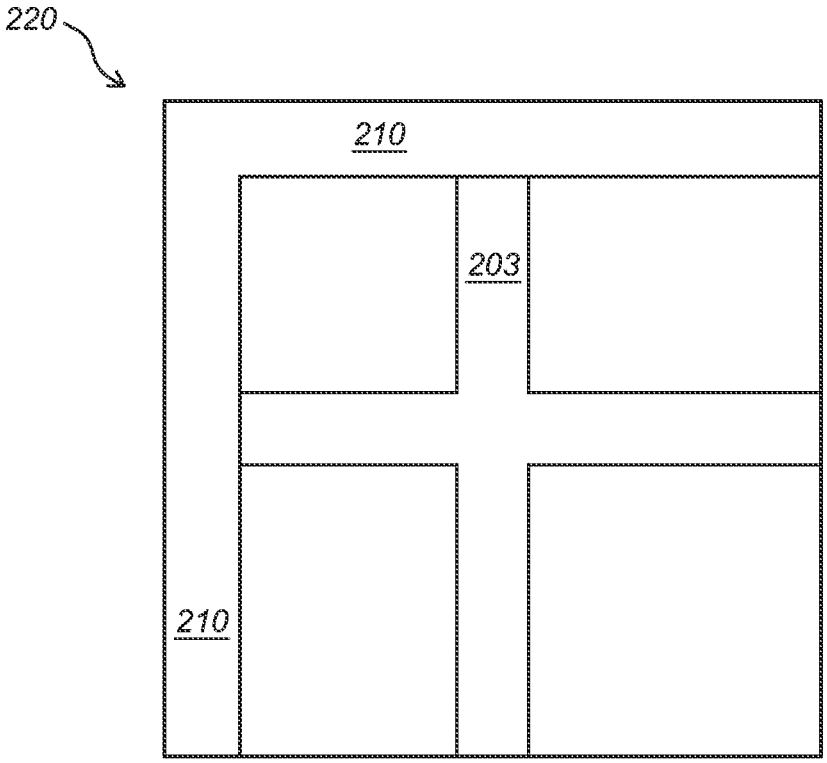
FIG. 2*b* shows a top view of the panel shown in FIG. 2*a;*

FIG. 2*a* shows a schematic representation of a side view of another example of a decorative panel (220) according to the present invention. The panel (220) comprises a core (200) provided with an upper side and a lower side, and a decorative top structure (201) affixed, directly or indirectly, on said upper side of the core (200). The decorative top structure (201) comprises a decorative print layer forming at least one décor image. The panel (220) also comprises a substantially transparent or translucent three-dimensional embossing structure (202) covering said print layer (201). In the shown embodiment comprises the embossing structure (202) a continuous printed base layer (204) provided with one or more internal grouts (203) with a concave shape, and an elevated pattern layer formed by a plurality of (discontinuous) elevations (205) printed on top of said continuous base layer (204). Two side edges of the panel (220), as also shown in FIG. 2*b*, are provided with an external grout (210), also referred to as peripheral grout line (210), wherein a lower rectangular part of the grout (210) is formed by the base layer (204), and wherein an upper part of the grout (210) is provided with a bevel (211) formed by one of the printed elevations (205). The elevations form part of a lacquer layer (205). A carrier layer (206), and in particular a primer layer (206) is present enclosed between the top structure (201) and the embossing structure (202). In the shown embodiment, the primer layer (206) comprises a pattern of mat primer (206A) and glossy primer (206B). The indentations (203) are present where the primer layer (206) is provided with mat primer (206A). The structured elevations (205) cover the glossy primer (206B) of the primer layer (206). Due to the embossing structure (202) being substantially transparent, the differences within the primer layer (206) are visible. It is also conceivable that the primer layer (206) is attached onto the upper side of the core (200), and that the decorative top structure (201) is attached onto the primer layer (206). FIG. 2*b* shows a top view of the panel (220) shown in FIG. 2*a*. It can be seen that due to a part of the base layer being provided with said plurality of indentations (203) and part of the base layer being free of indentations a visually observable pattern is obtained. This effect is further reinforced by the primer layer (206) comprising both mat and glossy primer (206A, 206B) in a pattern which is in line with the embossing structure (202).

Figure 3:
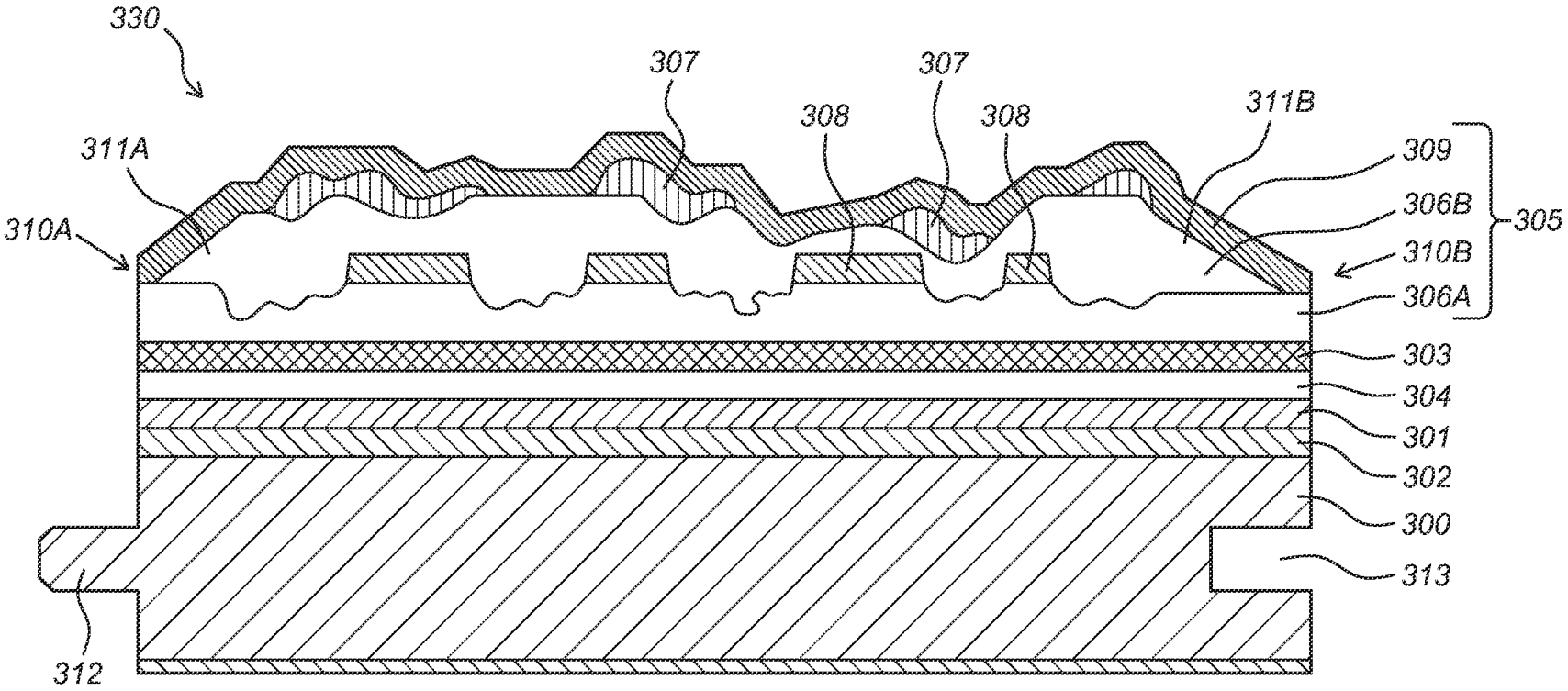
FIG. 3 shows a schematic representation of a further example of a decorative panel according to the present invention.

FIG. 3 shows a schematic representation of a further example of a decorative panel (330) according to the present invention. The figure show a cross section of a decorative panel (330), in particular a floor panel (330). The panel (330) comprises a rigid, flexible, or semiflexible core (300) provided with an upper side and a lower side. A decorative print layer (301) is indirectly affixed on the upper side of the core (300). A carrier layer (302) formed by a primer (302) is present in between the core (300) and the decorative layer (301) in order to provide better adhesion of the decorative layer (301). An intermediate layer (303) is present on top of the printed decorative top layer (301). The intermediate layer (303) is formed by a transparent or translucent, light-reflective thermoplastic layer (303). The light-reflective thermoplastic layer (303) is glued onto the printed decorative layer (301) by means of a hot melt glue layer (304). A substantially transparent or translucent three-dimensional embossing structure (305) is positioned on top op of aforementioned layers (300, 301, 302, 303, 304). The embossing structure (305) is a multi-layer embossing structure (305) which comprises two at least partially cured base layers (306A, 306B) provided with a plurality of indentations. A part of each base layer (306A, 306B) is free of indentations, although the upper base layer (306*b*) is provided at opposite edges (310*a*, 310*b*) of the panel (330) with a chamfering, meaning an inclined upper surface, to form a bevel (311*a*, 311*b*). The embossing structure (305) also comprises an elevated pattern layer (307) formed by a plurality of elevations printed on top of the upper base layer (306B). The elevations are both printed on parts of the base layer (306B) that respectively provided with indentations and parts that are free of indentations. Despite not shown, it is also conceivable that an embossing layer is present on top of the lower base layer (306A). A secondary printed decorated layer (308) is affixed to the lower base layer (306A). This printed decorative layer (308) is affixed to the parts of the base layer (306A) which is free of indentations. The entire panel (330) is covered with a finishing layer (309), in particular a lacquer layer (309), which follows the shape of the bevels (311*a*, 311*b*). The panel (330) benefits of the presence of two printed decorative layers (301, 308), resulting in that a unique visual pattern can be obtained. The indentations provided in the base layer (306A, 306B) typically have a depth situated in between 2 micron and 100 micron, preferably situated in between 3 micron and 50 micron. The elevations of the elevated pattern layer (307) typically have a height situated in between 2 micron and 500 micron, preferably situated in between 3 micron and 300 micron. The embossing structure, in particular one or both base layers (306A, 306B) and/or the pattern layer (307) and/or the finishing layer (309) is provided with a roughened texture by mechanically brushing these one or more layers (directly) after application. Here, it is conceivable that a layer is mechanically roughened (and optionally cleaned) prior to applying one or more further layers on top of said roughened layer. The core (300) which may be solid of foamed is provided at opposite edges with complementary coupling profiles (312, 313) schematically shown as a simple tongue and complementary groove, intended to interlock adjacent panels (300).

Figure 4A:
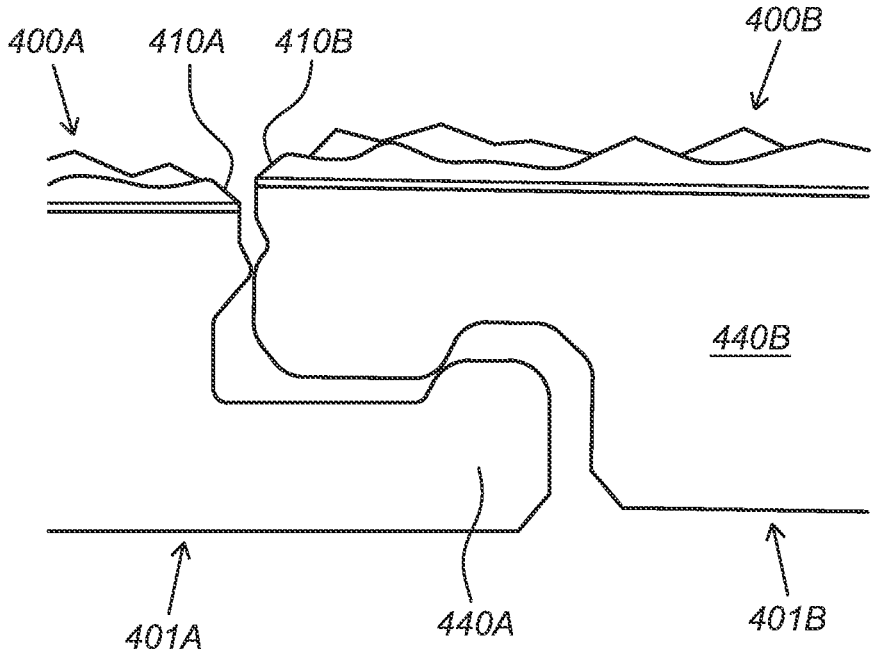
FIGS. 4*a* and 4*b* show non-limiting examples of coupling profiles used in panels according to the present invention, having an embossing structure with a mechanically roughened upper surface.
Figure 4B:
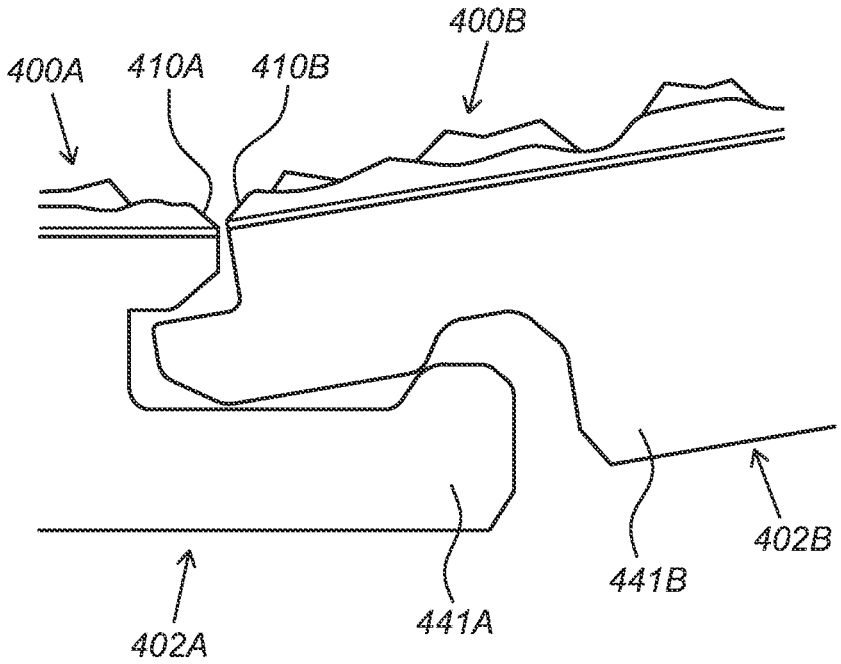

FIGS. 4*a* and 4*b* show non-limiting examples of coupling profiles (401A, 401B, 402A, 402B) used in panels (400A, 400B) according to the present invention, having an embossing structure with a mechanically roughened upper surface, e.g. as discussed and shown in the previous figures, and having printed bevels (410A, 410B) at two or four opposite edges. A first panel edge (440A) comprises a first coupling profile (401A), and a second panel edge (440B) opposite to the first panel edge (440A), comprising a second coupling profile (401B) being designed to engage interlockingly with said first coupling profile (401A) of an adjacent panel, both in horizontal direction and in vertical direction, wherein the first coupling profile (401A) and the second coupling profile (401B) are configured such that two of such panels can be coupled to each other by means of a lowering movement. This is shown in FIG. 4*a*. FIG. 4*b* show the panel comprising a third coupling profile (402A) and a coupling profile (402B) located respectively at a third panel edge (441A) and a fourth panel edge (441B). The third coupling profile (402A) and the fourth coupling profile (402B) are configured such that two of such panels (440A, 440B) can be coupled to each other by means of a turning movement, wherein, in coupled condition: at least a part of the sideward tongue of a first panel is inserted into the third groove of an adjacent, second panel, and wherein at least a part of an upward locking element of said second panel is inserted into the second downward groove of said first panel.

Figure 5A:
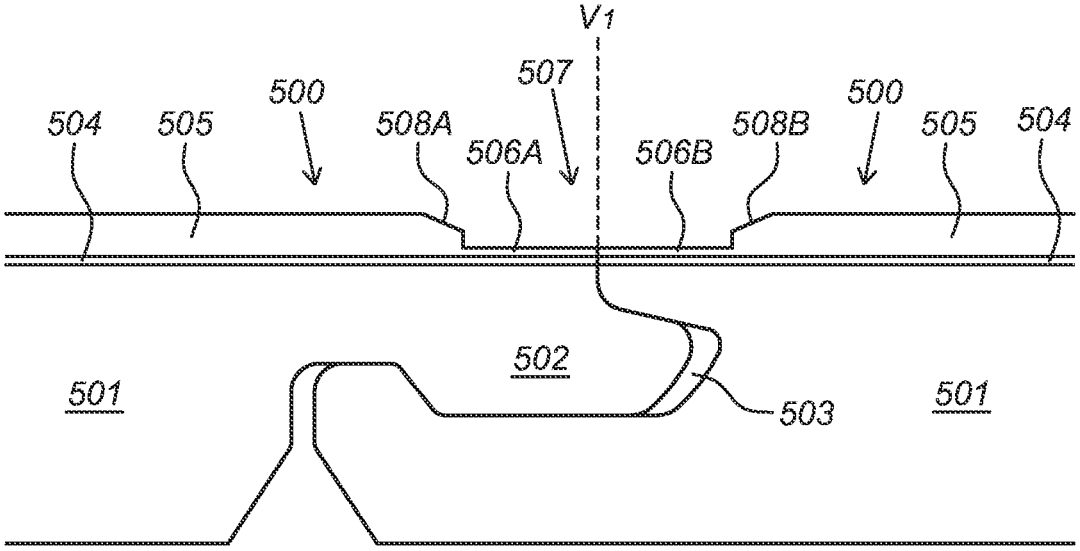
FIGS. 5*a* and 5*b* show two different embodiments (partial view) of a floor covering comprising (at least) two interconnected decorative panels according to the invention.
Figure 5B:
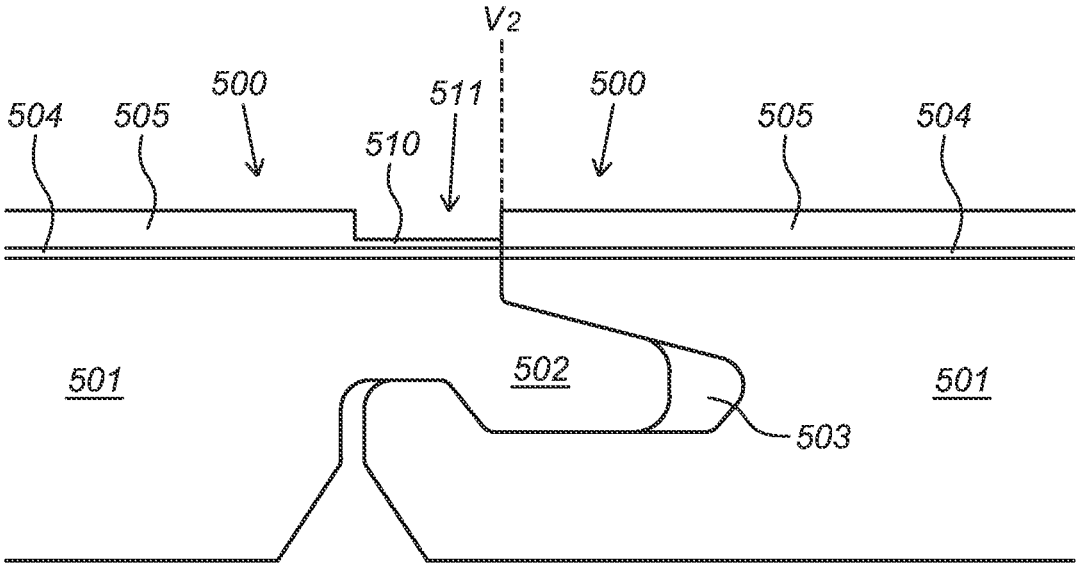

FIGS. 5*a* and 5*b* show two different embodiments of a floor covering comprising (at least) two interconnected decorative panels (500) according to the invention. In this figure, the panels are merely partially shown. Each decorative panel (500) comprises a rectangular, preferably oblong, core (501) which core (501) is provided at at least one pair of opposite sides with a tongue (502) and a complementary groove (503), which are configured to co-act with each other in such as way that the panels (500) are locked with respect to each other, both in horizontal direction (parallel to a plane defined by the panels (500)) and in vertical direction (perpendicular to said plane defined by the panels (500)). The tongue (502) is configured to be coupled into the groove (503) by means of an angling down movement (turning movement). The tongue (502) and the groove (503) are integrally formed with the core (501). On top of the core (501) a decorative layer (504) is applied, which may be formed by a decorative film or a decorative print directly printed on the core. On top of the decorative layer (504) a substantially transparent or translucent printed covering structure (505) entirely covering said decorative layer (504) is applied. In FIG. 5*a* it is shown that a seam between the panels (500) is defining a vertical plane $V_1$. In this figure it is also shown that the covering structure (505) is provided with a zone (506A, 506B) with a reduced thickness, both above the tongue (502) and above the groove (503), such that said zones (506A, 506B) of reduced thickness of adjacent panels (500) are connecting to each other to form a single grout line (507). Here, the grout line (507) is positioned partially at one side of the vertical plane $V_1$ and position partially at an opposite side of the vertical plane $V_1$. The grout line (507) has a substantially rectangular cross-section and is provided, near the top surface, with a bevel (508A, 508B). In FIG. 5*b* a slightly different embodiment is shown, wherein a seam between the panels (500) is defining a vertical plane $V_2$, and wherein the covering structure (505) is provided with a zone (510) with a reduced thickness, only above the tongue (502) and not above the groove (503). In an interconnected state of two panels (500), as shown, adjacent covering structures (505) together form a grout line (511), wherein one edge of the grout line (511) coincides with the vertical plane $V_2$.

Figure 6B:
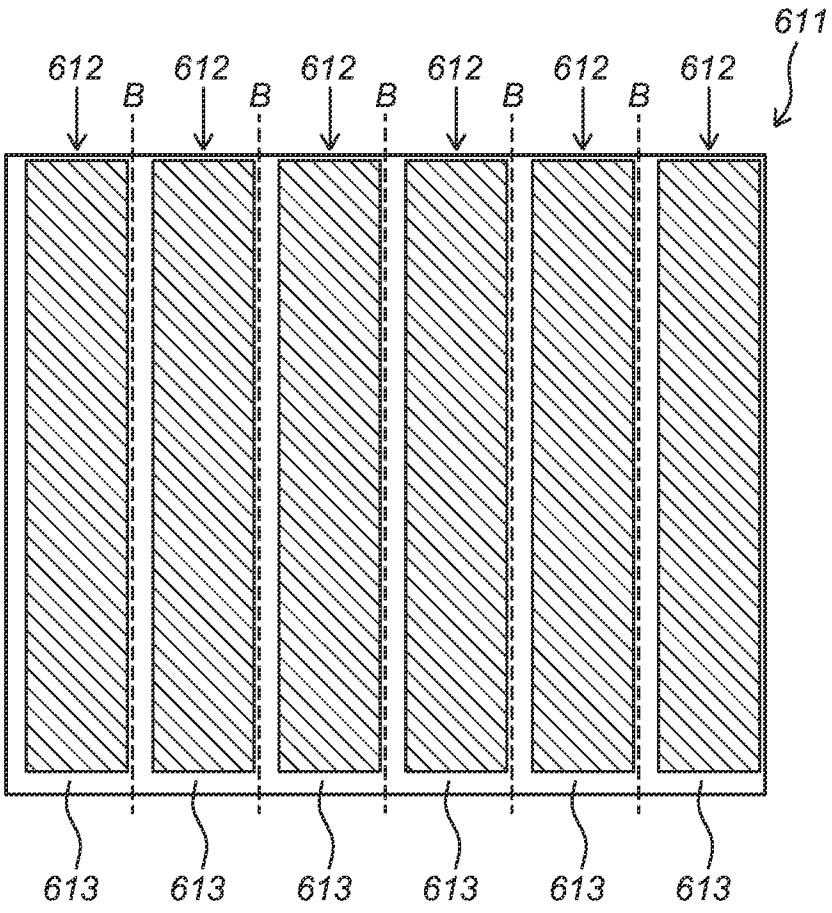
FIG. 6*b* shows a second different embodiment of a large panel or slab to be cut in smaller panels.
Figure 6A:
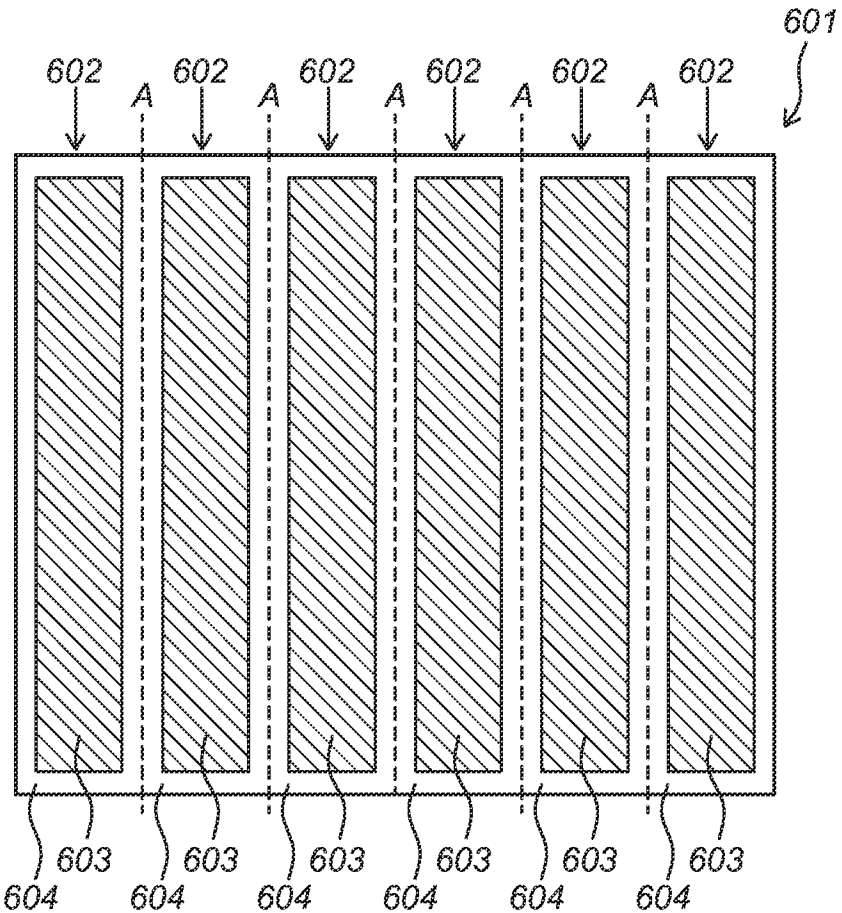
FIG. 6*a* shows a first different embodiment of a large panel or slab to be cut in smaller panels.

FIG. 6A shows a first different embodiment of a large panel or slab (601) to be cut in smaller panels according to the cutting lines (A) in order to form a plurality—here six—surface covering elements (602) according to the invention. The shaded areas indicate a flat or textured center portion (603) of a printed covering structure of each surface covering element (602), covering a center portion of an underlying decorative layer, and wherein a peripheral portion (604) of said printed covering structure is recessed with respect to the center portion (603) of the covering structure, and wherein the printed peripheral portion of the covering structure represents a peripheral bevel and/or a peripheral grout line, in particular a peripheral faux grout line. The peripheral portion covers at least one peripheral portion of the decorative layer. As shown, the peripheral portion extends to all four edges of the surface covering element (602). After cutting the slab (601) into surface covering elements (602), the edges of the surface covering elements (602), including the peripheral portion of the decorative layer and the peripheral portion of the covering structure will be machined, in particular profiled, typically by way of milling, in order to create interlockable surface covering elements (602). This construction may for example lead to the embodiment shown in FIG. 5A.

FIG. 6B shows a second different embodiment of a large panel or slab (611) to be cut in smaller panels according to the cutting lines (B) in order to form a plurality—here six—surface covering elements (612) according to the invention. This embodiment looks quite similar to the embodiment shown in FIG. 6A, but differs in that a recessed peripheral portion (613) of a printed covering structure extends only over two adjacent edges (a long edge and an adjacent short edge) of each surface covering element (612). This embodiment may for example lead to the embodiment shown in FIG. 5B.

Hence, the above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

The invention claimed is:

1. A decorative surface covering element, comprising:
- a core provided with an upper side and a lower side,
- a decorative top structure affixed, directly or indirectly, on said upper side of the core, said decorative top structure comprising:
- at least one decorative layer forming at least one décor image,
- a substantially transparent or translucent printed covering structure at least partially covering said decorative layer, wherein the printed covering structure comprises:
  - a printed center portion covering a center portion of the decorative layer, and
  - at least one printed peripheral portion adjacent to said center portion, and extending along a length of a side of the center portion, wherein said at least one peripheral portion covers at least one peripheral portion of the decorative layer,
  - wherein the peripheral portion of the covering structure is recessed with respect to the center portion of the covering structure, and wherein the printed peripheral portion of the covering structure represents a peripheral bevel and/or a peripheral grout line, and wherein at least one peripheral portion of the decorative layer is provided with a different print compared to the print of the center portion of the decorative layer.

2. The surface covering element according to claim 1, wherein the height of at least a part of the printed peripheral portion of the covering structure decreases in a direction away from the printed center portion of the covering structure.

3. The surface covering element according to claim 1, wherein at least a part of the peripheral portion of the covering structure has a chamfered top surface.

4. The surface covering element according to claim 1, wherein at least a part of the peripheral portion of the covering structure has a substantially flat top surface.

5. The surface covering element according to claim 1, wherein at least a part of the peripheral portion of the covering structure has a curved top surface.

6. The surface covering element according to claim 1, wherein at least a part of the peripheral portion of the covering structure has a top surface which is substantially parallel to a plane defined by the core.

7. The surface covering element according to claim 1, wherein the peripheral portion of the covering structure forms an at least partially concave channel.

8. The surface covering element according to claim 1, wherein the maximum height difference between a lowest region of the peripheral portion of the covering structure and an highest region of the center portion of the covering structure is situated between 200 and 800 micron.

9. The surface covering element according to claim 1, wherein the printed peripheral portion of the covering structure is formed by:
- at least one, at least partially cured layer provided with at least one indented zone, extending in longitudinal direction of the peripheral portion, and/or
- at least one at least partially cured elevated pattern layer formed by at least one elevated zone extending in longitudinal direction of the peripheral portion.

10. The surface covering element according to claim 1, wherein the printed center portion of the covering structure comprises at least one recessed channel representing an internal grout line.

11. The surface covering element according to claim 1, wherein at least one peripheral portion of the decorative layer is provided with a different print compared to the print of the center portion of the decorative layer.

12. The surface covering element according to claim 1, wherein the printed center portion of the covering structure is an embossed center portion, which is formed by:
- at least one, at least partially cured base layer provided with a plurality of indentations, and/or
- at least one at least partially cured elevated pattern layer formed by a plurality of elevations, preferably printed on top of said base layer.

13. The surface covering element according to claim 1, wherein a first edge of the surface covering element comprises a first coupling profile, and a second edge of the surface covering element, preferably opposite to the first edge, comprising a second coupling profile being designed to engage interlockingly with said first coupling profile of an adjacent surface covering element, both in horizontal direction and in vertical direction, wherein the first coupling profile and the second coupling profile are preferably configured such that two of such surface covering elements can be coupled to each other by means of a lowering movement.

14. The surface covering element according to claim 1, wherein the surface covering element comprises at least one third coupling profile and at least one fourth coupling profile located respectively at a third edge and a fourth edge, wherein the third coupling profile comprises:
- a sideward tongue extending in a direction substantially parallel to the upper side of the core,
- at least one second downward flank lying at a distance from the sideward tongue, and
- a second downward groove formed between the sideward tongue and the second downward flank,
- wherein the fourth coupling profile comprises:
- a third groove configured for accommodating at least a part of the sideward tongue of the third coupling profile of an adjacent surface covering element, said third groove being defined by an upper lip and a lower lip, wherein said lower lip is provided with an upward locking element,
- wherein the third coupling profile and the fourth coupling profile are configured such that two of such surface covering elements can be coupled to each other by means of a turning movement, wherein, in coupled condition: at least a part of the sideward tongue of a first surface covering element is inserted into the third groove of an adjacent, second surface covering element, and wherein at least a part of the upward locking element of said second surface covering element is inserted into the second downward groove of said first surface covering element.

15. The surface covering element according to claim 1, wherein the print of at least one peripheral portion of the decorative layer has a different color compared to the print of the center portion of the decorative layer.

16. The surface covering element according to claim 1, wherein at least one peripheral portion of the decorative layer is provided with a darker print compared to the print of the center portion of the decorative layer.

17. The surface covering element according to claim 1, wherein the at least one peripheral portion of the decorative layer has a more matt appearance compared to the print of the center portion of the decorative layer.

18. A method of producing a decorative surface covering element according to claim 1, comprising the steps of:

A) forming at least one decorative layer onto the upper side of the core by means of printing, wherein at least one peripheral portion of the decorative layer is provided with a different print compared to the print of the center portion of the decorative layer, B) applying a liquid base layer on at least a part of at least one décor image formed during step A) to form a center portion and at least one peripheral portion of the covering structure, position-selectively printing of a plurality of embossing droplets on the still liquid base layer in a manner, that the thickness of the base layer changes on the positions where the embossing droplets are spayed on, such that at these positions indentations are formed in the liquid base layer, and such that the average height of the center portion of the covering structure exceeds the average height of the peripheral portion of the covering structure, wherein the printed peripheral portion of the covering structure is formed as peripheral bevel and/or a peripheral grout line, C) at least partially curing said base layer provided with said indentations.

* * * * *